US009164473B2

(12) United States Patent
Iketani

(10) Patent No.: US 9,164,473 B2
(45) Date of Patent: Oct. 20, 2015

(54) IMAGE FORMING APPARATUS

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/229,428

(22) Filed: Mar. 28, 2014

(65) Prior Publication Data

US 2014/0294428 A1 Oct. 2, 2014

(30) Foreign Application Priority Data

Mar. 29, 2013 (JP) ..... 2013-071213

(51) Int. Cl.
*G03G 21/16* (2006.01)

(52) U.S. Cl.
CPC ..... *G03G 21/1633* (2013.01); *G03G 21/1666* (2013.01)

(58) Field of Classification Search
CPC ..... G03G 21/1633; G03G 21/1666; G03G 21/1623
See application file for complete search history.

(56) References Cited

U.S. PATENT DOCUMENTS

| | | | | |
|---|---|---|---|---|
| 5,539,447 | A * | 7/1996 | Akuta et al. | 347/263 |
| 8,918,010 | B2 * | 12/2014 | Tamura | 399/98 |
| 2007/0008400 | A1 * | 1/2007 | Kim | 347/224 |
| 2013/0322916 | A1 * | 12/2013 | Tamura | 399/98 |

FOREIGN PATENT DOCUMENTS

| | | | | |
|---|---|---|---|---|
| JP | H09-54484 | * | 2/1997 | B41J 2/44 |
| JP | 10-114129 | A | 5/1998 | |
| JP | 2002-356004 | * | 12/2002 | B41J 2/44 |
| JP | 2005-234123 | A | 9/2005 | |

OTHER PUBLICATIONS

An Office Action; "Notice of Reasons for Rejection," issued by the Japanese Patent Office on Jun. 9, 2015, which corresponds to Japanese Patent Application No. 2013-071213 and is related to U.S. Appl. No. 14/229,428.

* cited by examiner

*Primary Examiner* — Clayton E LaBalle
*Assistant Examiner* — Peter L Cheng
(74) *Attorney, Agent, or Firm* — Studebaker & Brackett PC

(57) ABSTRACT

An image forming apparatus includes a dustproof shutter, a lock lever, a shutter lever and an elastic member. The dustproof shutter is openably/closably supported in a case so as to protect an exposure device. The lock lever is configured to lock a cover openably/closably provided in the case, and to be movable in an opening direction of the cover. The shutter lever is provided at a position coming into contact with the lock lever and the dustproof shutter when the cover is closed. The elastic member biases the shutter lever toward the lock lever. The shutter lever moves between a first position to open the dustproof shutter when the cover is locked and a second position to close the dustproof shutter when the cover is unlocked by moving the lock lever in the opening direction of the cover with assistance from a biasing force of the elastic member.

4 Claims, 11 Drawing Sheets

IMAGE FORMING APPARATUS

INCORPORATION BY REFERENCE

This application is based on and claims the benefit of priority from Japanese Patent application No. 2013-071213 filed on Mar. 29, 2013, the entire contents of which are incorporated herein by reference.

BACKGROUND

The present disclosure relates to an image forming apparatus having a cover openably/closably provided in a case.

There is an image forming apparatus in which a cover is openably/closably provided in a case so as to become possible to carry out maintenance or the like of the inside of the case.

For example, there is a printer including a lock plate pulled to an initial position by a spring on a cover side, an unlock plate biased to a lock plate side by a torsion spring on a case side and a cover spring opening an unlocked cover. This printer has been configured so that when a release button is depressed, a lock is released and the cover is slightly opened by a resilient force of the cover spring. Thus, a user can easily recognize a cover opening direction.

However, in the above-mentioned printer, it is necessary to provide an exclusive cover spring opening the cover. The above-mentioned printer has a problem that the number of parts related to a cover opening/closing structure increases.

SUMMARY

An image forming apparatus includes a dustproof shutter, a lock lever, a shutter lever and an elastic member. The dustproof shutter is openably/closably supported in a case so as to protect an exposure device. The lock lever is configured to lock a cover openably/closably provided in the case, and provided to be movable in an opening direction of the cover. The shutter lever is provided at a position coming into contact with the lock lever and the dustproof shutter in a case where the cover is closed. The elastic member is configured to bias the shutter lever toward the lock lever. The shutter lever is provided to be movable between a first position to open the dustproof shutter when the cover is locked and a second position to close the dustproof shutter when the cover is unlocked by moving the lock lever in the opening direction of the cover with assistance from a biasing force of the elastic member.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

In the following, an entire structure of a printer as an image forming apparatus according to an embodiment of the present disclosure will be described with reference to the appended drawings. It is noted that in the following description, a front side of the printer 1 is defined by an arrow Fr shown in FIG. 1 and respective directions are defined by arrows shown in the figures.

Figure 1:
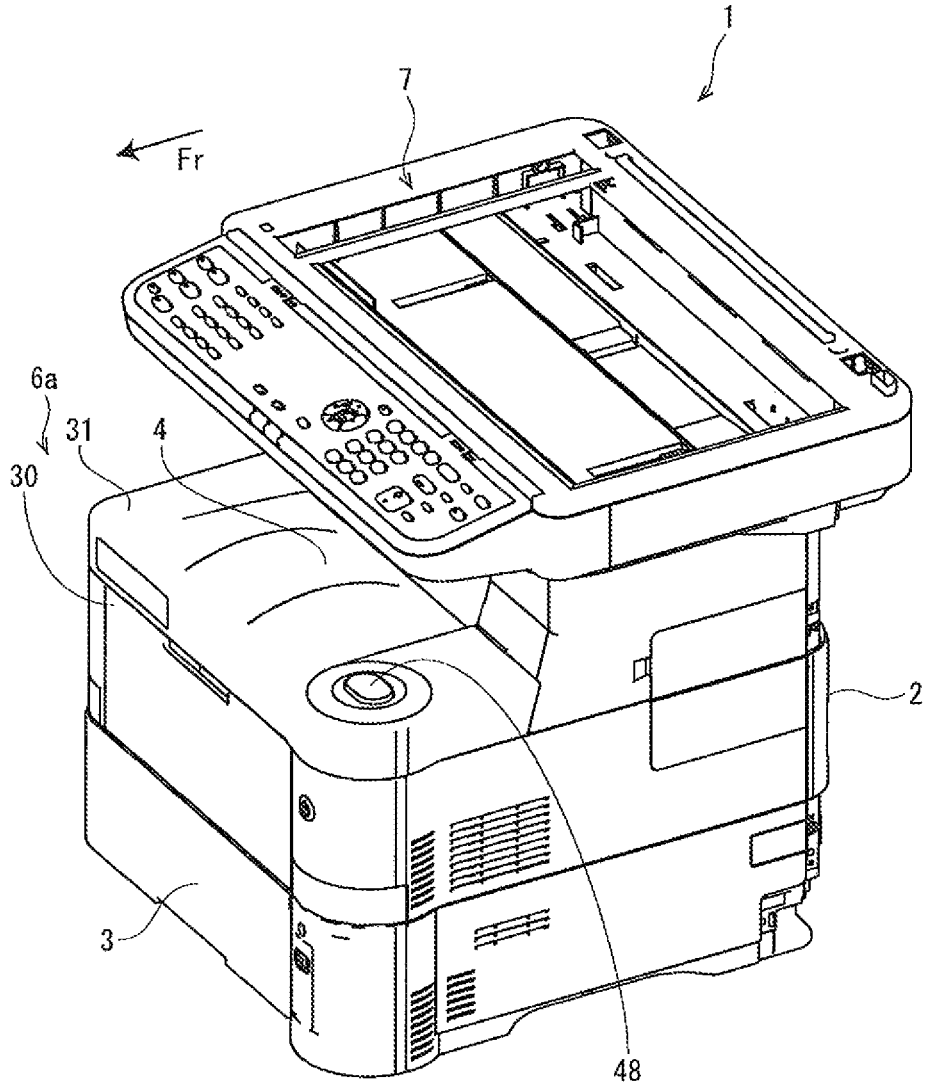
FIG. 1 is a perspective view showing a printer according to an embodiment of the present disclosure.
Figure 2:
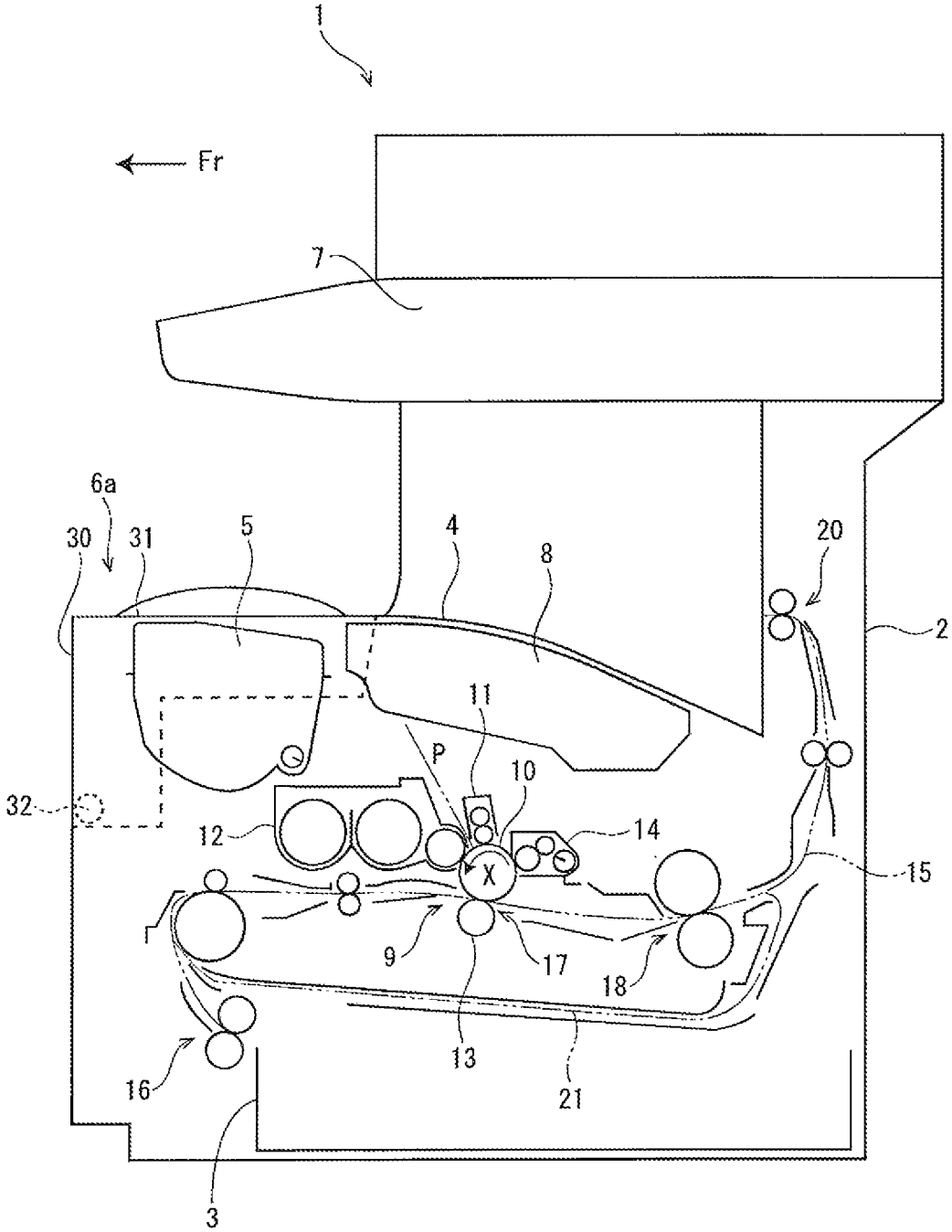
FIG. 2 is a sectional view schematically showing an internal structure of the printer according to the embodiment of the present disclosure.
Figure 3:
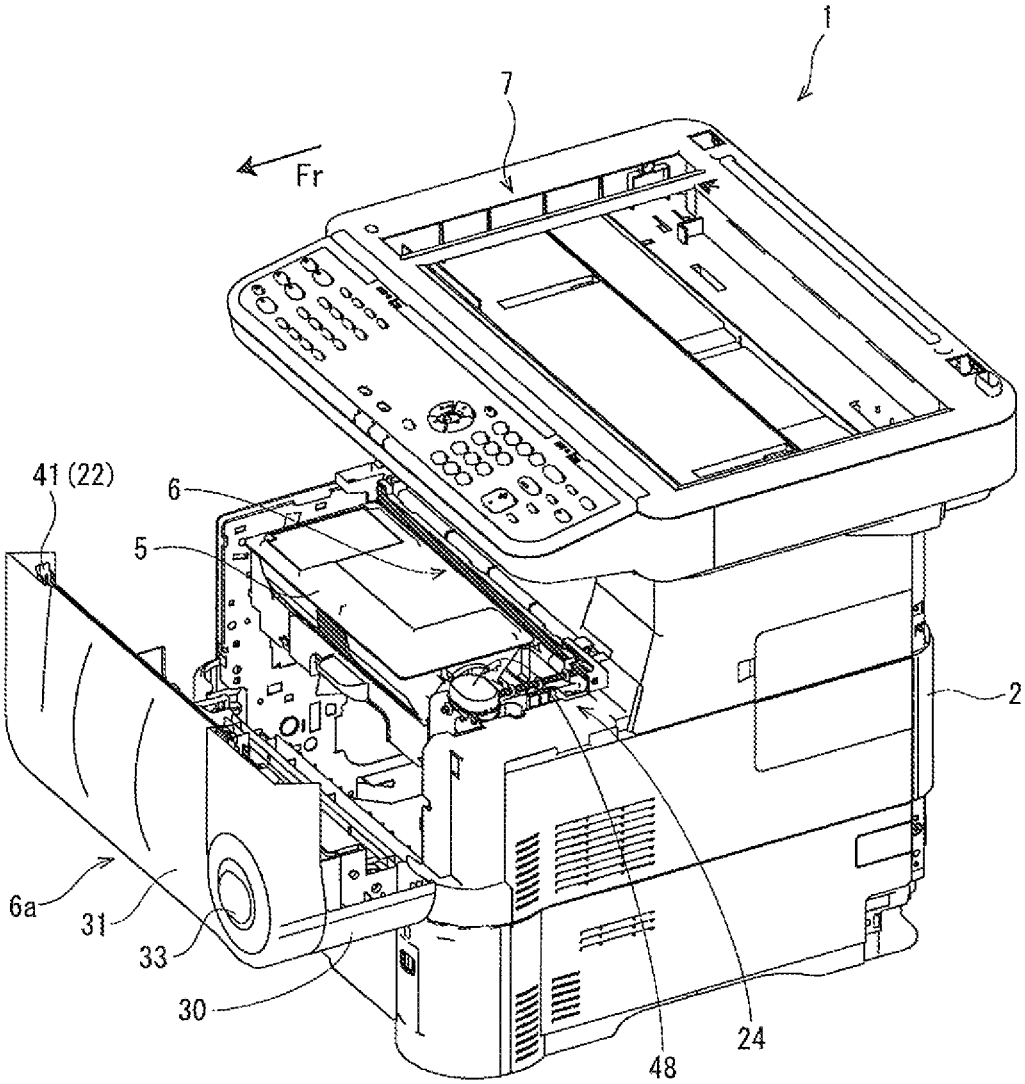
FIG. 3 is a perspective view showing the printer in a state, in which a front cover is opened, according to the embodiment of the present disclosure.

With reference to FIGS. 1 to 3, the printer 1 will be described. FIG. 1 is a perspective view showing the printer 1. FIG. 2 is a sectional view schematically showing an internal structure of the printer 1. FIG. 3 is a perspective view showing the printer 1 in a state, in which a front cover is opened.

As shown in FIG. 1 to FIG. 3, a printer 1 includes a box-shaped case 2. At a lower part of the case 2, a sheet feeding cartridge 3 to house sheets of paper (not shown) is provided. On a front top face of the case 2, an ejected sheet tray 4 is provided. At a lower part of the ejected sheet tray 4, a toner container 5 is installed attachably to/detachably from the case 2. A top face of the ejected sheet tray 4 and a front face of the case 2 constitute a front cover 6*a* as a cover. Although a detailed description will be given later, inside the case 2, at a rear side of the toner container 5, most of a case opening/closing device 6 opening/closing the front cover 6*a* is provided integrally with an exposure device 8. At an upper end part of the case 2, an image reading device 7 is provided.

As shown in FIG. 2, the exposure device 8 composed of a laser scanning unit (LSU) is disposed at a lower side of the ejected sheet tray 4 inside the case 2. At a lower side of the exposure device 8, an image forming unit 9 is provided. At the image forming unit 9, a photosensitive drum 10 as an image carrier is rotatably provided. Around the photosensitive drum 10, a charger 11, a development device 12, a transfer roller 13, and a cleaning device 14 are disposed along a rotating direction of the photosensitive drum 10 (refer to the arrow X of FIG. 2).

Inside the case 2, a sheet conveying path 15 is provided. In the conveying path 15, a sheet feeder 16, a transferring unit 17 composed of the photosensitive drum 10 and the transfer roller 13, a fixing device 18 and a sheet ejecting unit 20 are provided sequentially from an upstream side. At a lower side of the transferring unit 17 and the fixing device 18, an inversion path 21 for duplex printing is provided.

Next, an image forming operation of the printer 1 having such a configuration will be described.

The printer 1 initializes various parameters when power is turned ON, and executes initial settings such as temperature setting of the fixing device 18. In the printer 1, image data is inputted from a computer or the like connected to the printer 1, and when a printing start instruction is supplied, an image forming operation is executed as described below.

First, a charger 11 charges a surface of the photosensitive drum 10. The exposure device 8 carries out exposure corresponding to the image data with respect to the photosensitive drum 10 charged by laser light (refer to double-dotted chain line P of FIG. 2). In this manner, an electrostatic latent image is formed on the surface of the photosensitive drum 10. The electrostatic latent image is developed as a toner image by a toner supplied from the toner container 5 to the development device 12.

On the other hand, the sheet taken out from the sheet feeding cartridge 3 by the sheet feeder 16 is conveyed to the transferring unit 17 in exact timing with the above-mentioned image forming operation. The transferring unit 17 transfers a toner image on the photosensitive drum 10 to the sheet. The sheet to which the toner image is transferred is conveyed to a downstream side in the conveying path 15, and enters the fixing device 18. The fixing device 18 fixes the toner image to the sheet. The sheet to which the toner image is fixed is ejected from the sheet ejecting unit 20 to the ejected sheet tray 4. The toner remaining on the photosensitive drum 10 is re-collected by the cleaning device 14.

Figure 4A:
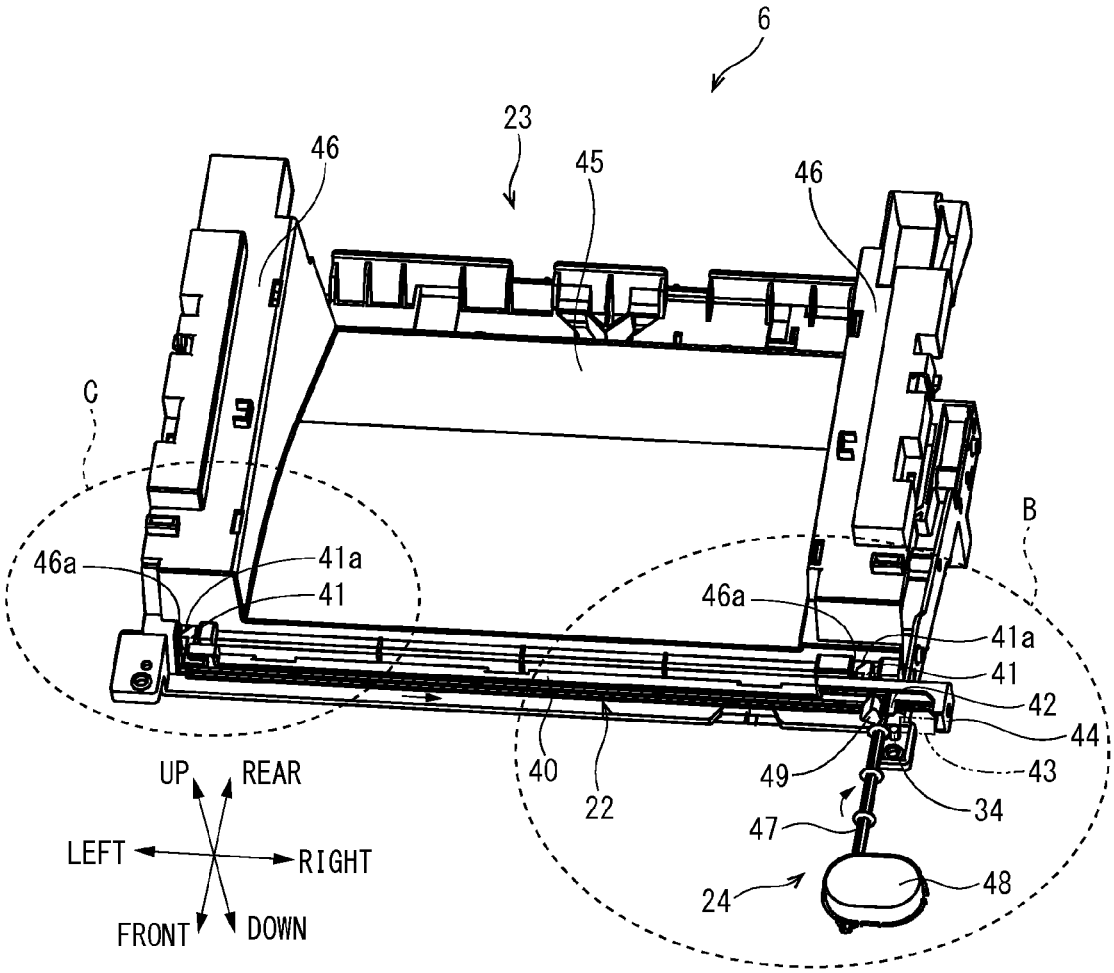
FIG. 4A is a perspective view showing a case opening/closing device of the printer according to the embodiment of the present disclosure.
Figure 4B:
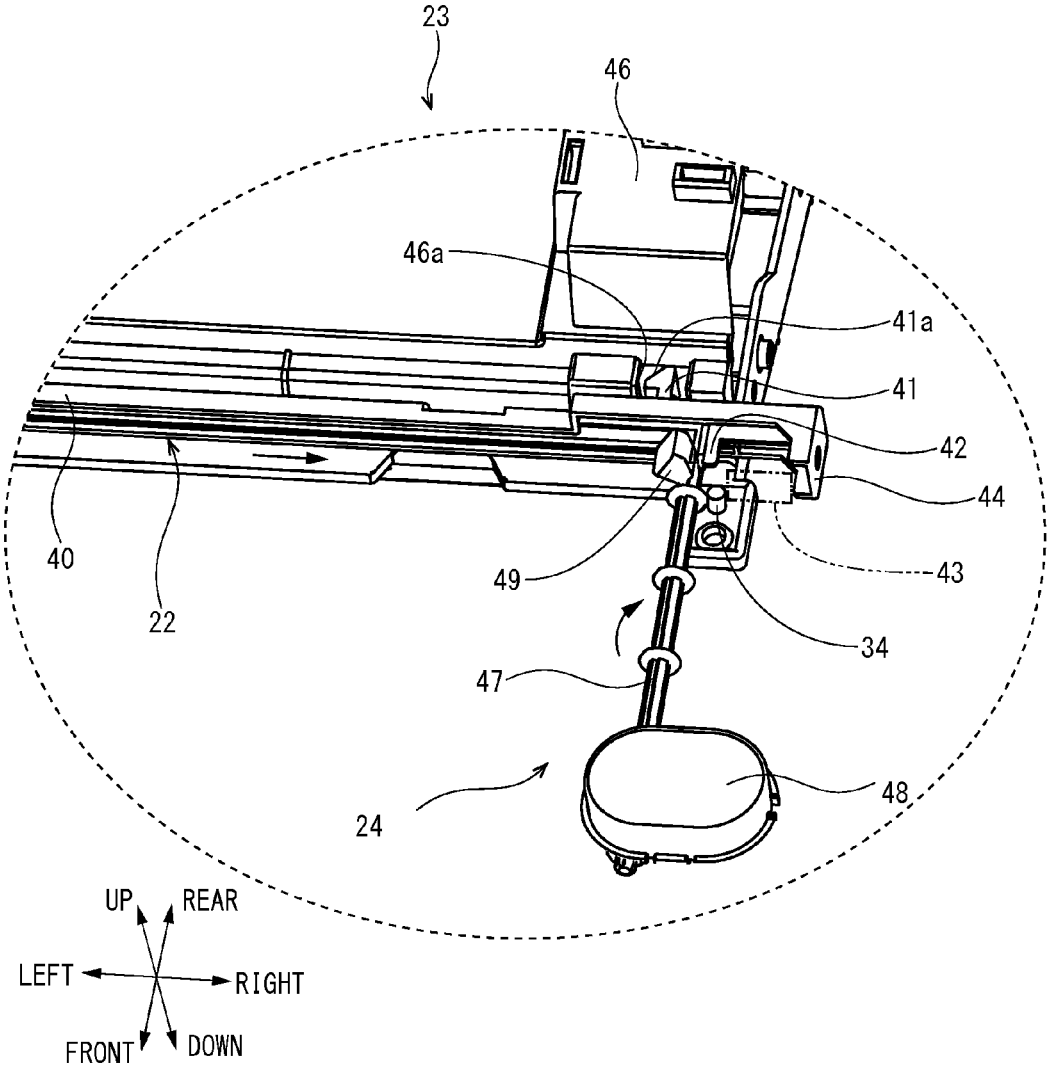
FIG. 4B is an enlarged view of a B part in FIG. 4A.
Figure 4C:
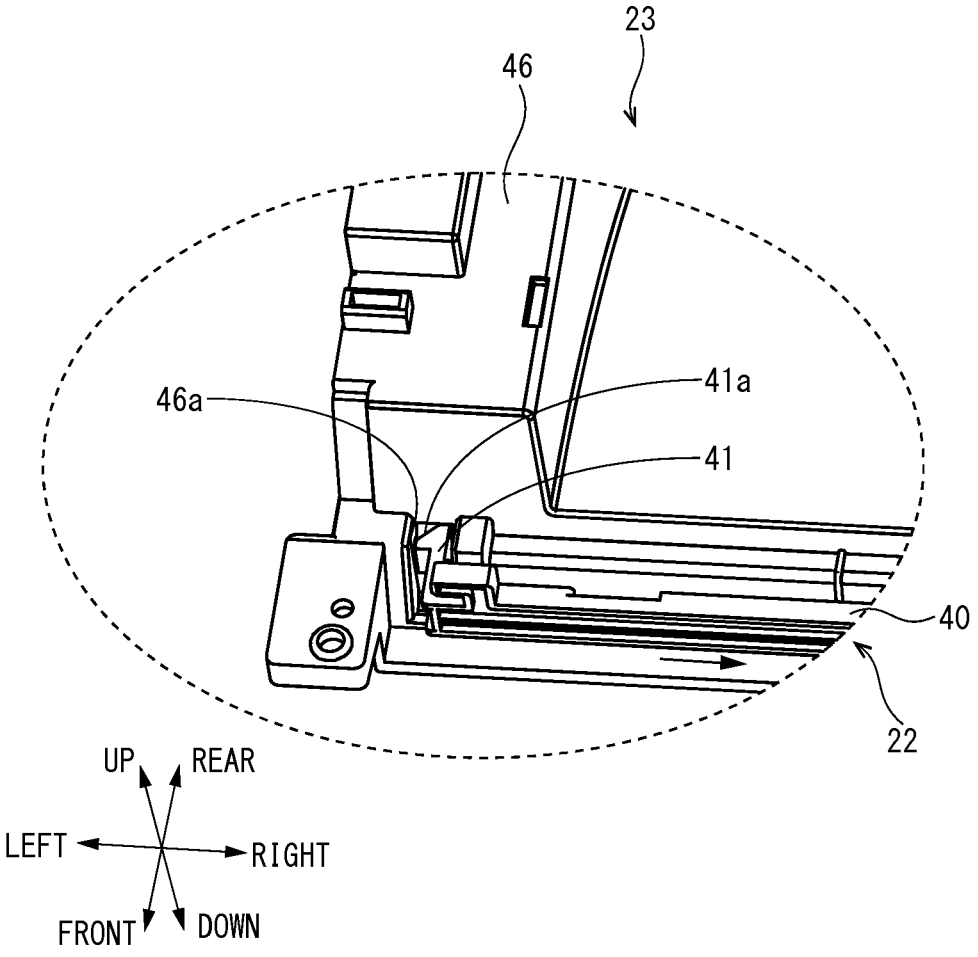
FIG. 4C is an enlarged view of a C part in FIG. 4A.
Figure 5:
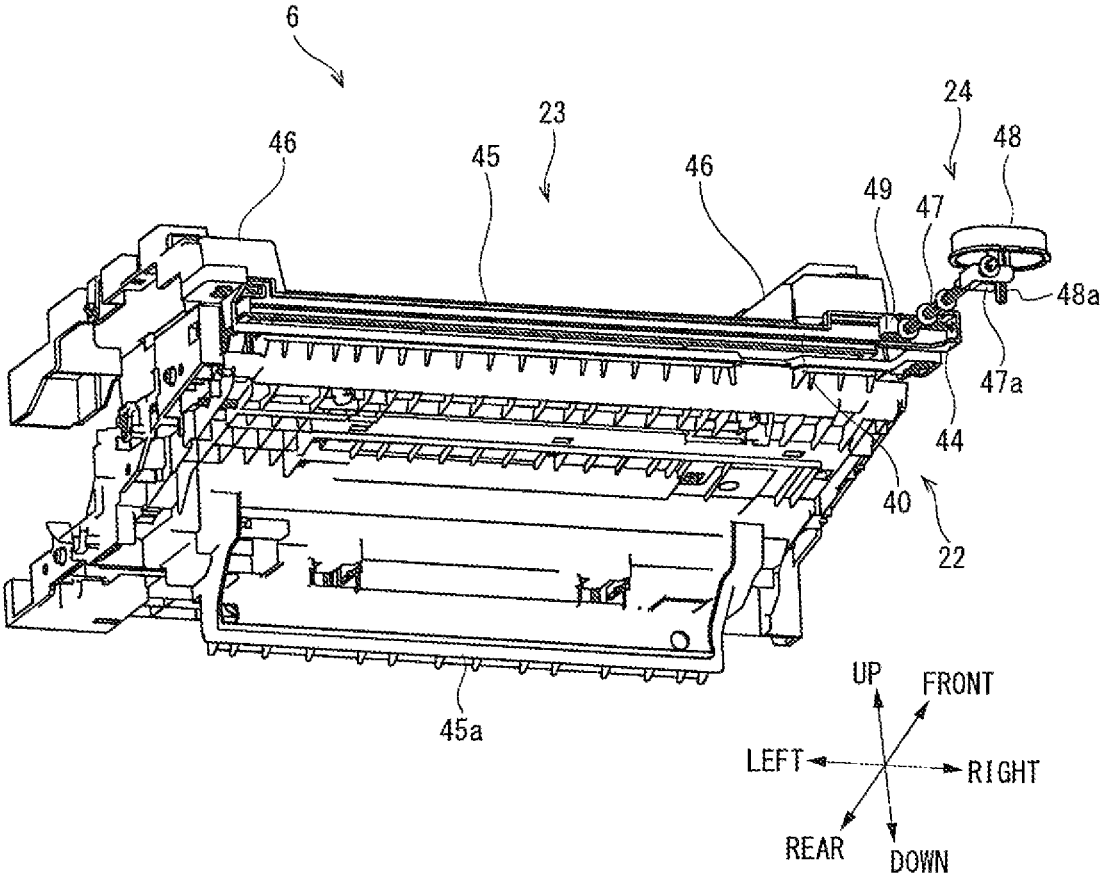
FIG. 5 is a perspective view showing the case opening/closing device in another view of the printer according to the embodiment of the present disclosure in another direction.
Figure 6:
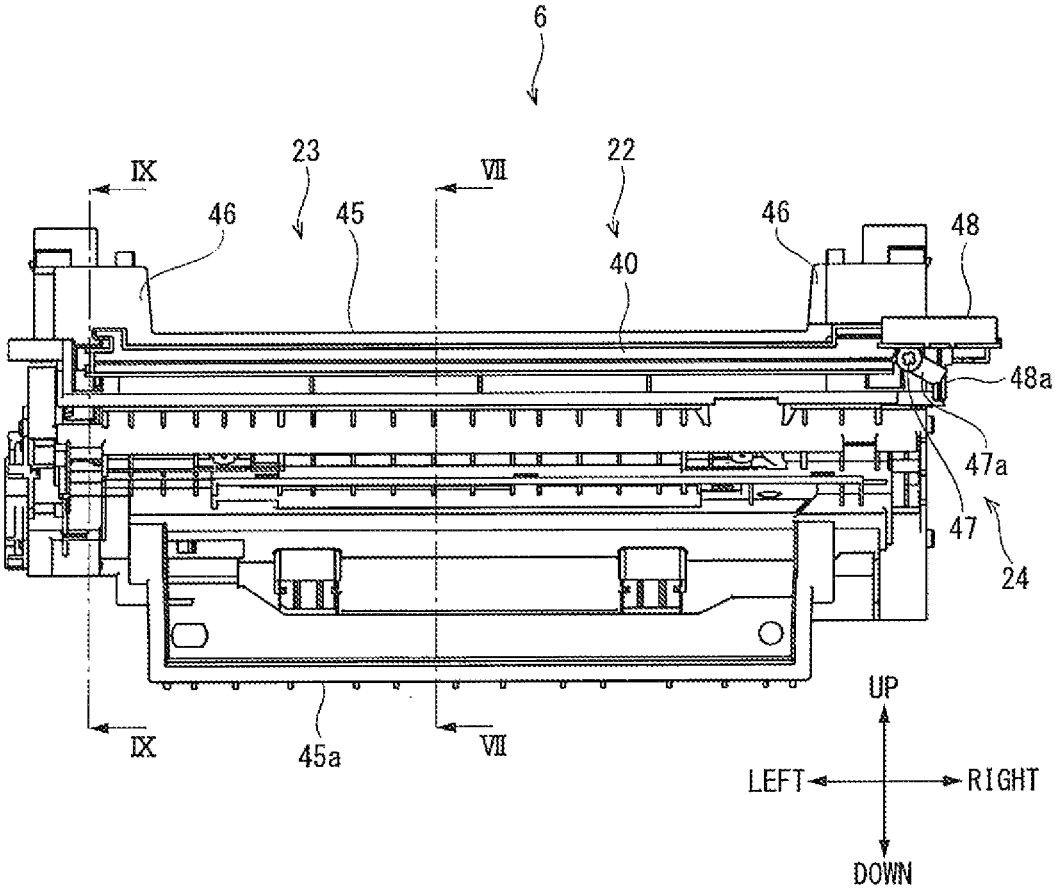
FIG. 6 is a front view showing the case opening/closing device of the printer according to the embodiment of the present disclosure.
Figure 7:
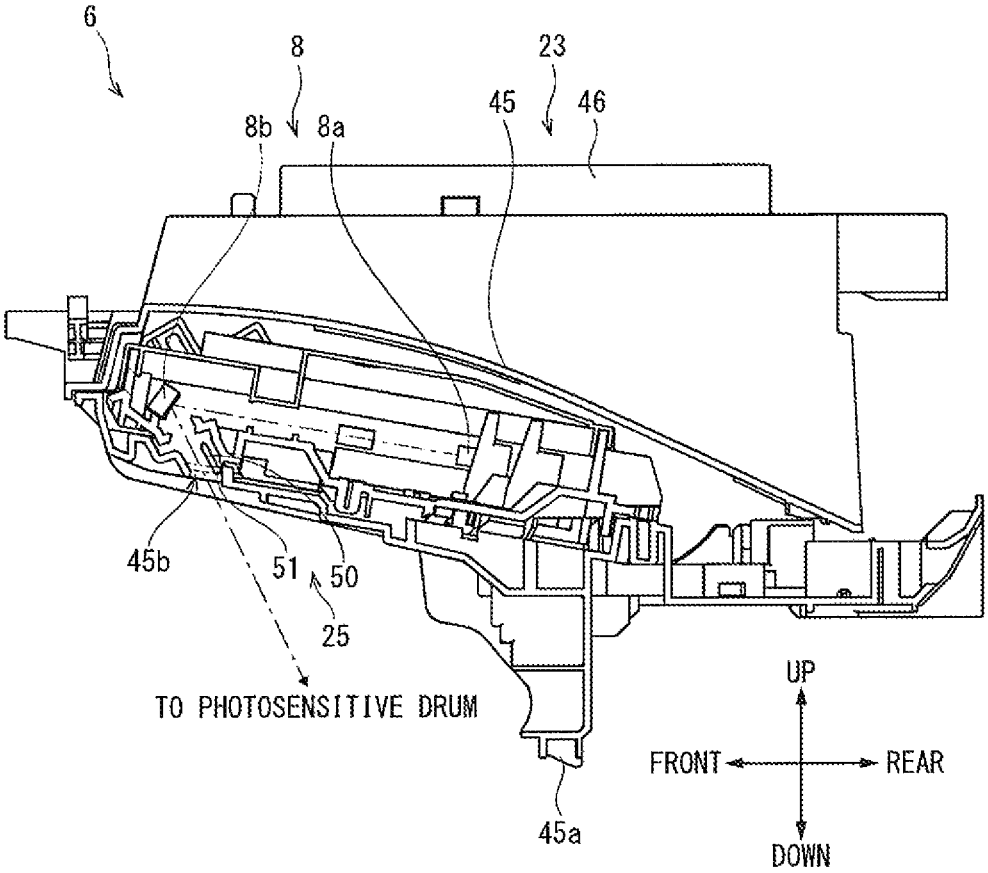
FIG. 7 is a sectional view taken along the line VII-VII in FIG. 6.
Figure 8:
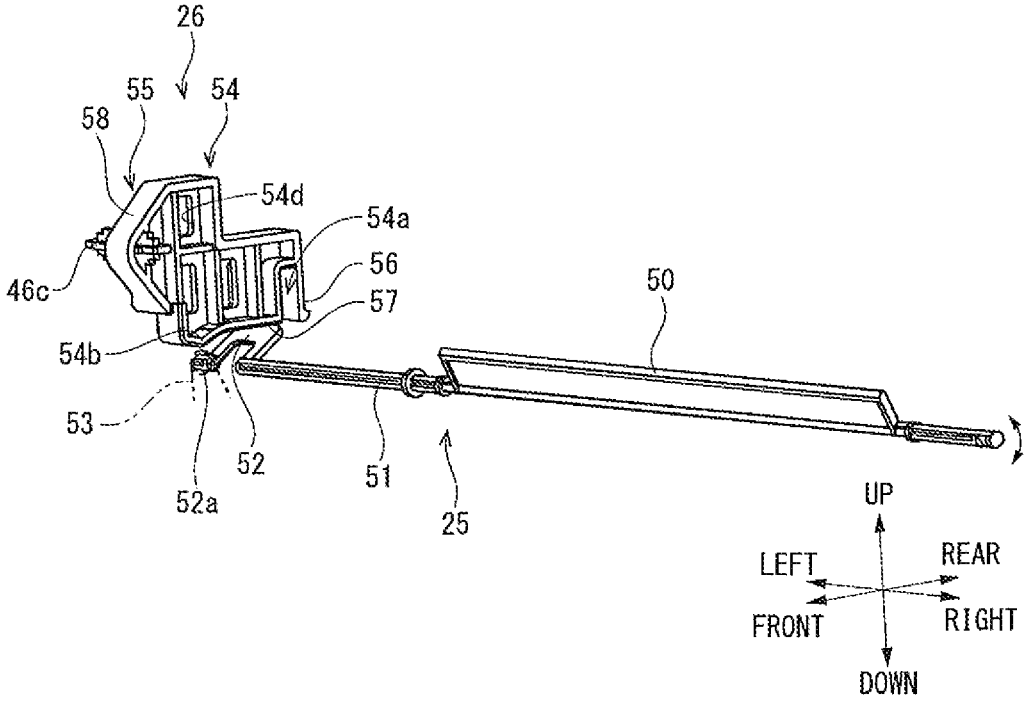
FIG. 8 is a perspective view showing a dustproof shutter and a shutter lever according to the embodiment of the present disclosure.
Figure 9A:
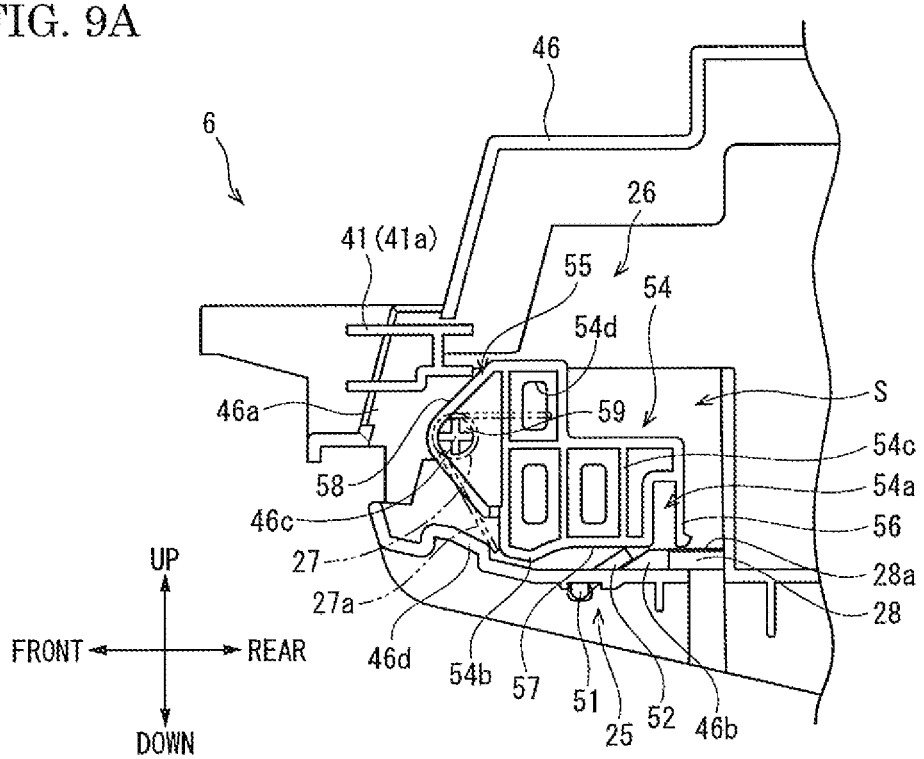
FIG. 9A shows a state in which the shutter lever meets a first position in a front part of the sectional view taken along the line IX-IX in FIG. 6.
Figure 9B:
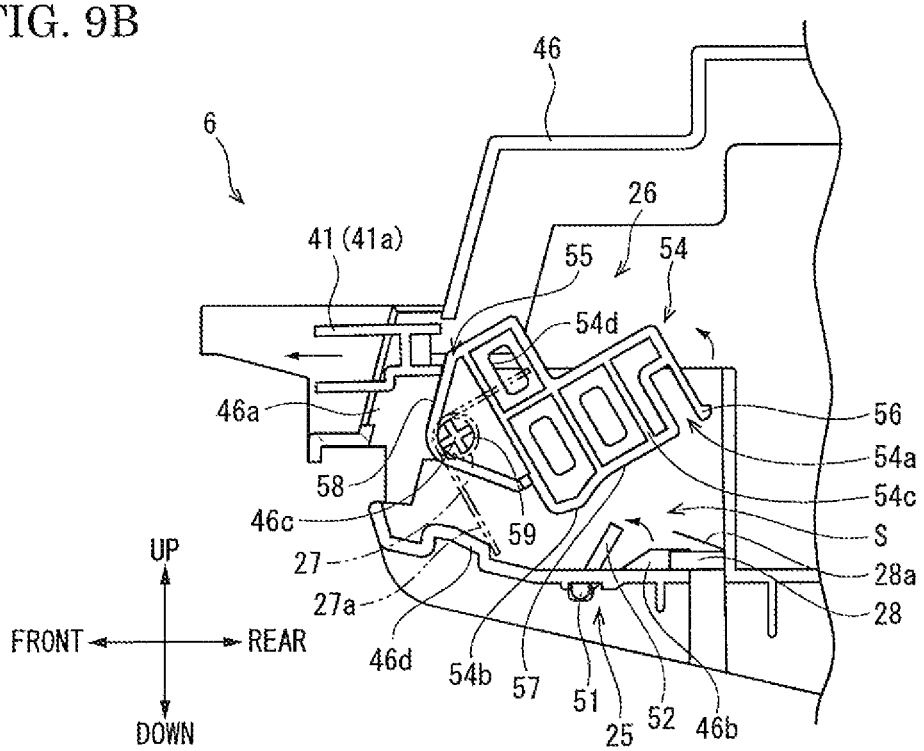
FIG. 9B shows a state in which the shutter lever meets a second position in the front part of the sectional view taken along the line IX-IX in FIG. 6.

Next, with reference to FIG. 1 to FIG. 9, the case opening/closing device 6 opening/closing the front cover 6*a* will be described. FIG. 4A and FIG. 5 are perspective views showing the case opening/closing device 6. FIG. 4B is an enlarged view of a B part in FIG. 4A. FIG. 4C is an enlarged view of a C part in FIG. 4A. FIG. 6 is a front view showing the case opening/closing device 6. FIG. 7 is a sectional view taken along the line VII-VII in FIG. 6. FIG. 8 is a perspective view showing a dustproof shutter and a shutter lever. FIG. 9A shows a state in which the shutter lever meets a first position in a front part of the sectional view taken along the line IX-IX in FIG. 6. FIG. 9B shows a state in which the shutter lever meets a second position in the front part of the sectional view taken along the line IX-IX in FIG. 6. Hereinafter, unless otherwise specified in particular, a description will be given with reference to a state in which the front cover 6*a* is closed (refer to FIG. 1).

As shown in FIG. 3 to FIG. 9, the case opening/closing device 6 includes a lock lever 22, a device case 23, an operating mechanism 24, a dustproof shutter 25, a shutter lever 26, a lever side spring 27 and an interlock switch 28. The lock lever 22 is provided to lock the front cover 6*a* and to be movable in an opening direction integrally with the front cover 6*a*. The device case 23 is configured as a case forming an essential appearance. The operating mechanism 24 is provided on a front end face of the device case 23. The dustproof shutter 25 is openably/closably supported in the device case 23 so as to protect the exposure device 8. The shutter lever 26 is provided at a position coming into contact with the left and right hook parts 41 of the lock lever 22 and the dustproof shutter 25 in a state where the front cover 6*a* is closed. The lever side spring 27 is configured as an elastic member biasing the shutter lever 26 toward the lock lever 22 side. The interlock switch 28 detects an open/closed state of the front cover 6*a*.

As shown in FIG. 1 to FIG. 3, the front cover 6*a* includes a side plate 30 and a top plate 31. The side plate 30 is extended in a vertical direction so as to cover a front side of the toner container 5 in a closed state. The top plate 31 extended rearward so as to cover an upper side of the toner container 5 from an upper end of the side plate 30. The front cover 6*a* is formed in a substantial L-shape in a lateral view. The front cover 6*a* is turnably supported about a supporting shaft 32 provided at a lower end of the side plate 30 (refer to FIG. 2). That is, the front cover 6*a* is openably/closably attached at the case 2. Also, at a front right end part of the top plate 31, a button hole 33 is formed (refer to FIG. 3). Through the button hole 33, an unlock button 48 described later is exposed in a state in which the front cover 6*a* is closed. The front cover 6*a* is opened in order to access the inside of the case 2 at the time of maintenance such as replacement of the toner container 5 or handling of a jammed sheet of paper (jam handing).

As shown in FIG. 3 and FIG. 4A to FIG. 4C, the lock lever 22 is attached to a bottom face rear end part of the top plate 31 of the front cover 6*a* in a closed state. The lock lever 22 has a rod-shaped lock main body 40, a pair of left and right hook parts 41, a link cam follower 42 and a return spring 43. The lock main body 40 is extended along left and right directions. The hook parts 41 are provided at both the left and right end parts of the lock main body 40. The link cam follower 42 is provided at one end part (for example, right end part) of the lock main body 40. The return spring 43 biases the lock main body 40 in a leftward direction.

The lock main body 40 is supported on a bottom face of the top plate 31 slidably in the left and right directions via a bracket (not shown). The hook parts 41 are respectively extended toward a rear side from the proximity of the left end and the right end of the lock main body 40. At a distal end part (rear end part) of each hook part 41, a barb part 41*a* is formed to protrude leftward obliquely toward a front side.

The link cam follower 42 has a cross-shaped cross section, and is extended toward a front side at an opposite position to the left side hook part 41 across the lock main body 40.

The return spring 43 is a so called coil spring, and is arranged at a right side of the lock main body 40. In detail, this spring extends rightward of the link cam follower 42, and the return spring 43 is positioned between a spring latch part 44 having a distal end formed to be bent forward, and a boss 34 protruded on a bottom face of the top plate 31 of the front cover 6*a*.

As shown in FIG. 4A to FIG. 6, the device case 23 has a case main body 45 formed in a substantially thin box and a pair of left and right case protrusion parts 46 protruding upward from both the left and right end parts on the top face of the case main body 45.

The top face of the case main body 45 is formed to be inclined downward while curving toward a rear side. Also, at a substantial center in forward and backward directions on the bottom face of the case main body 45, a lower side protrusion part 45*a* is formed so as to protrude downward.

As shown in FIG. 7, inside the case main body 45, the exposure device 8 is provided. The exposure device 8 has a polygon motor 8*a* scanning laser light emitted from a laser light source (not shown) and a mirror 8*b* reflecting the scanned laser light. On the bottom face of the case main body 45, a laser aperture 45*b* emitting the laser light reflected by the mirror 8*b* to the photosensitive drum 10 is formed.

As shown in FIG. 4A to FIG. 4C, on the front end face of each case protrusion part 46, an engaging hole 46*a* with which the above-mentioned barb part 41*a* of each hook part 41 is engagingly locked is formed. The lock main body 40 is biased in a leftward direction by the return spring 43, whereby each barb part 41*a* is maintained in an engagingly locked state with each engaging hole 46*a*. In this manner, the front cover 6*a* is locked so as not to be openable.

Also, inside of the left side case protrusion part 46, a space S is provided in order to arrange the shutter lever 26 (refer to FIG. 9). Further, at a bottom part of the left side case protrusion part 46, an opening (not shown) communicating between the outside and the space S is formed, and a contact protrusion part 46*b* having an inclined plane inclined upward from a rear end of this opening is protruded (refer to FIG. 9).

As shown in FIG. 4A to FIG. 6, the operating mechanism 24 has a link lever 47 extended from a front end face of the right side case protrusion part 46 to a front side, an unlock button 48 provided at an upper part of a front end of the link lever 47 and a link cam 49 provided at a rear end part of the link lever 47.

The link lever 47 forms a rod shape, and is supported in a state in which the lever is turnable about a shaft, at a position on a leftward lower side of a link cam follower 42. At the front end part of the link lever 47, a button contact portion 47*a* supporting an unlock button 48 is locked. The button contact portion 47*a* is attached to extend from the link lever 47 in a rightward direction.

The unlock button 48 forms an elliptical shape in a planar view. On a bottom face of the unlock button 48, a cross-shaped sectional button supporting shaft 48*a* is formed to extend downward. The button supporting shaft 48*a* forms a stepped shape in which a diameter on a proximal side is larger than that of a distal side. A distal end part of the button supporting shaft 48*a* is supported to be inserted into the button contact portion 47*a* from an upper side.

The link cam 49 forms a substantially equilateral triangle in a front view. The link cam 49 is fixed to the link lever 47. An oblique face (an oblique side) of the link cam 49 comes into contact with a lower left side of the link cam follower 42.

As shown in FIG. 7 and FIG. 8, the dustproof shutter 25 is provided inside the case main body 45. The dustproof shutter 25 has a shutter main body 50 opening/closing the laser aperture 45*b*, a rod-shaped shutter turning shaft 51 turning the shutter main body 50 and a dustproof lever 52 fixed at an end (for example, left end) of the shutter turning shaft 51.

The shutter main body 50 is formed in the shape of a thin rectangular plate elongated in the left and right directions. The shutter main body 50 fixes one longer side to a slight right side in the left and right directions of the shutter turning shaft 51. Also, the shutter main body 50 extends so that another longer side is positioned at an upper oblique front side.

The shutter turning shaft 51 is turnably supported on a bearing part (not shown) provided in the case main body 45 in the vicinity of the left and right ends of the shutter main body 50.

The dustproof lever 52 is formed in the shape of a substantially U-shaped flat plate in a planar view (or in a front view). A right end part at an opening side in the U-shape of the dustproof lever 52 is locked to a left end part of the shutter turning shaft 51. Also, the dustproof lever 52 is locked to the shutter turning shaft 51 so as to extend in a direction different from the shutter main body 50, that is, to an upper oblique rear side. At a left end part of the dustproof lever 52, a spring supporting shaft 52*a* shaped to be coaxial to the shutter turning shaft 51 is formed. The spring supporting shaft 52*a* is pivotally supported on a lower face of a left side case protrusion part 46. The dustproof lever 52 enters the space S through an opening formed at a bottom part of the case protrusion part 46.

Also, around the spring supporting shaft 52*a*, a dustproof side spring 53 as a dustproof side elastic member is wound. The dustproof side spring 53 is a so called torsion coil spring. The dustproof side spring 53 is arranged to have a biasing force turning the shutter main body 50 toward an upper side via the shutter turning shaft 51.

As shown in FIG. 8 and FIG. 9, the shutter lever 26 is provided in the space S of the left side case protrusion part 46. The shutter lever 26 has a lever main body 54 forming an essential appearance and a lever cam 55 provided integrally with a front end face of the lever main body 54.

The lever main body 54 is formed in a substantial L-shape bent upward in a lateral view. At a rear end part of the lever main body 54, a depression part 54*a* is formed. The depression part 54*a* is cut in a rectangular shape from a lower side to an upper side in a lateral view. On a rear end face of the lever main body 54, a switch pressing part 56 having a lower end as a free end is perpendicularly provided. On a lower end face of the lever main body 54 positioned at a front side of the depression part 54*a*, a pressing face 57 is formed. The pressing face 57 is formed substantially horizontally in a state in which the front cover 6*a* is closed. Also, between the pressing face 57 and a front end of the lever main body 54, a protrusion part 54*b* protruding in a triangular shape toward a lower side is formed. With the pressing face 57, a dustproof lever 52 of the dustproof shutter 25 comes into contact.

Inside the lever main body 54, a rib 54*c* is provided. By means of the rib 54*c*, the inside of the lever main body 54 is partitioned in a plurality of rectangular spaces in a lateral view. In detail, one rectangular space is provided on an upper side, and three rectangular spaces are provided in parallel on a lower side.

The lever cam 55 protrudes toward a front side at an upper position on a front end face of the lever main body 54. The lever cam 55 is formed in a substantially isosceles triangle in a lateral view. At an upper side of the lever cam 55, an inclined cam face 58 inclined downward toward a front side is formed. The inclined cam face 58 comes into contact with a distal end face (rear end face) of a hook part 41 (barb part 41*a*) engagingly locked to the left side engaging hole 46*a*. At a lower side of the lever cam 55 as well, a face having an inclination corresponding to a vertically inversion of the above-mentioned inclined cam face 58 is formed.

Also, at a front end corner portion of the lever cam 55, a lever bearing part 59 is formed to penetrate in the left and right directions. Into the lever bearing part 59, a lever turning shaft 46*c* having a cross-shaped section is inserted as a turning shaft provided inside of the left side case protrusion part 46. In this manner, the shutter lever 26 is turnably supported on the lever turning shaft 46*c*.

As shown in FIG. 9, a lever side spring 27 is a so called torsion coil spring. The lever side spring 27 is provided so as to be wound around the lever turning shaft 46*c*. One arm part 27*a* of the lever side spring 27 is engagingly connected to an arm engaging hole 54*d* formed in a rectangular shape at the upper side of the lever main body 54. The other arm part 27*a* is engagingly connected to a protrusion 46*d* provided at a bottom part of the left side case protrusion part 46. In this manner, the lever side spring 27 is arranged to have a biasing force turning the shutter lever 26 toward an upper side.

An interlock switch 28 is provided at the bottom part of the left side case protrusion part 46. The interlock switch 28 has an actuator unit 28*a* with which or from which the switch pressing part 56 of the lever main body 54 comes into contact or is separated.

Next, with reference to FIG. 9, an opening operation of the front cover 6*a* by the case opening/closing device 6 will be described.

In a state before starting the opening operation, the front cover 6*a* is closed in a locked state by the lock lever 22. The unlock button 48 meets a button hole 33 opened in the top plate 31 (refer to FIG. 1).

Also, in the state before starting the opening operation, as shown in FIG. 9A, the inclined cam face 58 of the shutter lever 26 comes into contact with the barb part 41*a* (hook part 41) engagingly locked to the left side engaging hole 46*a*. Thus, the shutter lever 26 is pressed downward against a biasing force of the lever side spring 27. The switch pressing part 56 of the shutter lever 26 depresses the actuator unit 28*a* of the interlock switch 28. In this manner, a control device (not shown) detects a switch ON state, and recognizes that the front cover 6*a* is in a closed state.

Further, in the state before starting the opening operation, the pressing face 57 of the shutter lever 26 presses the dustproof lever 52 to an inclined plane of the contact protrusion part 46*b* against the biasing force of the dustproof side spring 53. At this time, the shutter main body 50 of the dustproof shutter 25 is in an opened state (refer to the solid line of FIG. 7). That is, the laser aperture 45*b* is opened. Irradiation of the photosensitive drum 10 with laser light becomes possible. In the description, a position of the shutter lever 26, in a case where the front cover 6*a* is locked by the lock lever 22, to open the dustproof shutter 25 is called as a first position.

In order to release the front cover 6*a* from the state in which the front cover 6*a* is locked, a user depresses the unlock button 48.

The button contact portion 47*a* receives a force in a depressing direction via the button supporting shaft 48*a* of the unlock button 48. The button contact portion 47*a* turns toward a lower side about an axial center of the link lever 47 (refer to FIG. 6). Also, the link lever 47 and the link cam 49 formed integrally with the button contact portion 47*a* turn about a shaft of the button contact portion 47*a*. The turning link cam 49 presses the link cam follower 42 in a rightward direction. The lock lever 22 slides in a rightward direction against the biasing force of the return spring 43 (refer to FIG. 4A to FIG. 4C).

Also, each hook part 41 formed integrally with the lock lever 22 slides in a leftward direction. An engaging lock between each barb part 41*a* and each engaging hole 46*a* is released. Namely, a lock of the front cover 6*a* by the lock lever 22 is released (refer to FIG. 4 A to FIG. 4C).

As shown in FIG. 9B, when the front cover 6*a* is unlocked, the shutter lever 26 is turned upward about the lever turning shaft 46*c* by the biasing force of the lever side spring 27. By this turning, the shutter lever 26 pushes the hook part 41 coming into contact with the inclined cam face 58 forward. At this time, since the engaging lock between the hook part 41 (barb part 41*a*) and each engaging hole 46*a* is released, the lock lever 22 slightly moves in the opening direction (forward) of the front cover 6*a*.

The user pulls the front cover 6*a* in the slightly moved direction (forward). In this manner, the front cover 6*a* turns about the supporting shaft 32, and is opened.

In addition, when the front cover 6*a* is unlocked and the shutter lever 26 turns, the switch pressing part 56 is separated from the actuator unit 28*a* of the interlock switch 28. In this manner, the control device detects a switch OFF state, and recognizes that the front cover 6*a* is in an open state.

Further, when the front cover 6*a* is unlocked and the shutter lever 26 turns, the pressing face 57 is separated from the dustproof lever 52. Thus, the shutter main body 50 is turned downward by the biasing force of the dustproof side spring 53, and shifted to a closed state (refer to the double-dotted chain line of FIG. 7). That is, a pressing force from the pressing face 57 is released as the shutter lever 26 moves from the first position to a second position, and the dustproof shutter 25 is closed. In this manner, the laser aperture 45*b* is closed. Therefore, entry of dust or the like into the case main body 45 is prevented, and the exposure device 8 inside thereof is protected.

In the description, a position of the shutter lever 26, in a case where the front cover 6*a* is unlocked, to move the lock lever 22 in the opening direction of the front cover 6*a* by the biasing force of the lever side spring 27 and to close the dustproof shutter 25 is called as a second position.

In order to close the opened front cover 6*a*, the front cover 6*a* is turned in a closed direction, and is pushed rearward. In this manner, each hook part 41 (barb part 41*a*) of the lock lever 22 enters each engaging hole 46*a*.

Then, the left hook part 41 pushes the shutter lever 26 against the biasing force of the lever side spring 27. In this manner, the shutter lever 26 moves (or turns) from the second position to the first position. Also, the dustproof shutter 25 (shutter main body 50) moves (or turns) so as to shift from the closed state to an open state.

Afterwards, the lock lever 22 is slid leftward by the biasing force of the return spring 43, and each barb part 41*a* shifts to an engagingly locked state to each engaging lock 46*a*. In this manner, the front cover 6*a* becomes a state locked by the lock lever 22.

With the printer 1 according to the foregoing embodiment, the shutter lever 26 biased by the lever side spring 27 simultaneously holds a function moving the front cover 6*a* in the opening direction via the lock lever 22 and a function closing the dustproof shutter 25 (closing the laser aperture 45*b*). Thus, it is possible to omit a particular spring or the like required to open/close the unlocked front cover 6*a*. In this manner, it is possible to reduce the number of parts relevant to an opening/closing structure of the front cover 6*a*. Also, since, in an unlocked state, the front cover 6*a* can be moved in the opening direction, the user can easily recognize the opening direction of the front cover 6*a*. In this manner, it is possible to guide the user to a correct opening operation of the front cover 6*a*.

Also, the shutter lever 26 further holds a function activating the interlock switch 28. In this manner, it is possible to reduce the number of parts related to the opening/closing structure of the front cover 6*a* and to simplify an internal construction of the case 2.

Although, in the embodiment, the shutter lever 26 is turnably structured, instead of this, the shutter lever may be constructed to be linearly slidable in the forward and backward directions. In this case also, it is possible to move the lock lever 22 (hook part 41) in the opening direction (forward) of the front cover 6*a*.

However, in a case as the embodiment of turning the shutter lever 26 and move the lock lever 22 in the opening direction via the inclined cam face 58, a layout space can be reduced, for example, in comparison with another case of moving linearly the shutter lever 26. Also, since the lock lever 22 slides on the inclined cam face 58, turning of the shutter lever 26 and movement of the lock lever 22 can be smoothly carried out. Further, since the pressing force from the pressing face 57 against the dustproof shutter 25 is released at the second position, the dustproof shutter 25 can be appropriately shifted to the closed state by the biasing force of the dustproof side spring 53.

Although, in the embodiment, the lock lever 22 is provided on the front cover 6*a*'s side, the lock lever 22 may be provided on the device case 23's side. In such a case, it is preferable that the lock lever 22 be configured to be slightly movable in the forward and backward directions (in the opening direction) after the lever has been unlocked.

In addition, although, in the embodiment, opening of the front cover 6*a* is detected when the interlock switch 28 is turned OFF, the detection may be made when the interlock switch 28 is turned ON. In such a case, when the shutter lever 26 has moved from the first position to the second position, the interlock switch 28 is arranged so that the shutter lever 26 and the actuator unit 28*a* come into contact with each other.

Although, in the embodiment, the front cover 6*a* is configured to be openable/closable, instead of this, for example, a top cover, a left cover, a right cover, and a rear cover or the like of the case 2 may be configured to be openable/closable.

In addition, although the embodiment is described in a case of applying the present disclosure to the printer 1, the present disclosure may be applied to an image forming apparatus such as a copying machine, a facsimile machine, or a multi-function peripheral, for example.

Since the foregoing description of the embodiment of the present disclosure is intended to set forth the preferable embodiment in the printer 1 according to the present disclosure, although there may be a case of providing various limitations which are technically preferable, the technical scope of the present disclosure is not limited to these aspects unless otherwise there exists a descriptive matter to limit the present disclosure in particular. Further, the constituent elements in the foregoing embodiment of the present disclosure can be appropriately replaced with the existing constituent elements or the like, and diversified variations including a combination with any other existing constituent elements are possible, and the contents of the disclosure set forth in the claims are not limited by the foregoing description of the embodiment of the present disclosure.

What is claimed is:

1. An image forming apparatus comprising:

a dustproof shutter openably and closably supported in a case so as to protect an exposure device from dust;

a lock lever configured to lock a cover openably and closably provided in the case, and provided to be movable in an opening direction of the cover;

a shutter lever provided at a position coming into contact with the lock lever and the dustproof shutter in a state where the cover is closed;

an elastic member configured to bias the shutter lever toward the lock lever, a dustproof side elastic member configured to bias the dustproof shutter in a closing direction; and a turning shaft configured to turnably support the shutter lever, wherein the shutter lever has an inclined cam face coming into contact with the lock lever and a pressing face coming into contact with the dustproof shutter, the shutter lever is provided to be movable between a first position to open the dustproof shutter when the cover is locked and a second position to close the dustproof shutter when the cover is unlocked by moving the lock lever in the opening direction of the cover with assistance from a biasing force of the elastic member that is configured to bias the shutter lever toward the lock lever, the lock lever relatively slides on the inclined cam face, and the dustproof shutter is moved in a closing direction by a biasing force of the dustproof side elastic member with a pressing force from the pressing face being released as the shutter lever moves from the first position to the second position.

2. The image forming apparatus according to claim 1, further comprising:

an interlock switch provided to come into contact with the shutter lever at the first position or the second position, and configured to detect an opened or closed state of the cover.

3. An image forming apparatus comprising:

a dustproof shutter openably and closably supported in a case so as to protect an exposure device from dust;

a lock lever configured to lock a cover openably and closably provided in the case, and provided to be movable in an opening direction of the cover;

a shutter lever provided at a position coming into contact with the lock lever and the dustproof shutter in a state where the cover is closed;

an elastic member configured to bias the shutter lever toward the lock lever, and an operating mechanism having a link lever, an unlock button provided at an upper part of a front end of the link lever, and a link cam provided at a rear end part of the link lever, wherein the shutter lever is provided to be movable between a first position to open the dustproof shutter when the cover is locked and a second position to close the dustproof shutter when the cover is unlocked by moving the lock lever in the opening direction of the cover with assistance from a biasing force of the elastic member, the lock lever has a rod-shaped lock main body, a hook part provided at each end part of the lock main body, a link cam follower provided at an end part of the lock main body; and a return spring configured to bias the lock main body in an axial direction, the case has a corresponding engaging hole configured to engagingly lock to each hook part, the link lever and the link cam are turned by depressing the unlock button, and the turned link cam presses the link cam follower, slides the lock lever against a biasing force of the return spring, and releases an engaging lock between each hook part and its corresponding engaging hole to unlock the cover.

4. The image forming apparatus according to claim 1, wherein the case has a laser aperture for irradiating a photosensitive drum with laser light from the exposure device, the dustproof shutter has a shutter main body for opening and closing the laser aperture, a rod-shaped shutter turning shaft configured to turn the shutter main body, and a dustproof lever locked to an end part of the shutter turning shaft, and the dustproof lever extends in a direction different from the shutter main body, and comes into contact with the pressing face of the shutter lever.

* * * * *